US007258261B1

(12) United States Patent
Reyes

(10) Patent No.: US 7,258,261 B1
(45) Date of Patent: Aug. 21, 2007

(54) NAIL GUN EXTENSION AND ACTUATING APPARATUS

(76) Inventor: Reynaldo Reyes, 8349 N. 56th Dr., Glendale, AZ (US) 85302

( * ) Notice: Subject to any disclaimer, the term of this patent is extended or adjusted under 35 U.S.C. 154(b) by 0 days.

(21) Appl. No.: 11/217,548

(22) Filed: Sep. 2, 2005

(51) Int. Cl.
*B25C 7/00* (2006.01)
*B25C 5/10* (2006.01)

(52) U.S. Cl. ..... 227/110; 227/156; 173/170

(58) Field of Classification Search ..... 227/110, 227/111, 156; 173/31, 32, 34, 170; 30/296.1; 254/131.5; 408/712
See application file for complete search history.

(56) References Cited

U.S. PATENT DOCUMENTS 2,908,482 A * 10/1959 Curtis et al. ..... 173/161
3,949,817 A 4/1976 Rice
4,153,193 A * 5/1979 Urbanowicz ..... 227/156
4,197,764 A 4/1980 Auernhammer
4,284,223 A * 8/1981 Salcido et al. ..... 227/5
4,479,599 A * 10/1984 Conrad ..... 227/9
4,736,804 A 4/1988 Geibel
5,295,620 A * 3/1994 Cousineau et al. ..... 227/156
5,361,851 A 11/1994 Fox
5,411,238 A * 5/1995 Caron ..... 248/664
5,546,749 A 8/1996 Couchee
D438,444 S 3/2001 Tor
6,901,695 B2 * 6/2005 Lindroth ..... 47/1.43

* cited by examiner

*Primary Examiner*—Sameh H. Tawfik
*Assistant Examiner*—Nathaniel Chukwurah

(57) ABSTRACT

A nail gun extension and actuating apparatus includes an elongated pole that has a bottom end and a top end. A coupler is attached to the pole and is positioned adjacent to the top end. The coupler is configured to releasably secure a nail gun to the pole so that a nozzle of the nail gun is orientated generally perpendicular to a longitudinal axis of the pole and a trigger of the nail gun is adjacent to the top end. An actuating assembly is attached to the pole and is configured to selectively engage and actuate the trigger of the nail gun.

13 Claims, 5 Drawing Sheets

NAIL GUN EXTENSION AND ACTUATING APPARATUS

BACKGROUND OF THE INVENTION

1. Field of the Invention

The present invention relates to tool extension devices and more particularly pertains to a new tool extension device for holding a nail gun in such a manner that the nail gun may be selectively extended above a user to nail objects which would otherwise not be reachable.

2. Description of the Prior Art

The use of tool extension devices is known in the prior art. U.S. Pat. No. 5,546,749 describes a device that may be attached to a nail gun to extend the useful reach of the nail gun. Another type of tool extension device is U.S. Pat. No. 4,197,764 having a configuration adapted for extending the reach of a powered handheld garden tool. Still another such device is found in U.S. Pat. No. 5,361,581 which describes an extension assembly for extending the reach of a power drill. Yet another such device is found in U.S. Pat. No. 3,949,817 that is configured for lengthening the reach of a chainsaw.

While these devices fulfill their respective, particular objectives and requirements, the need remains for a device that may be secured to a nail gun to allow a user of the nail gun to use the nail gun in areas which would otherwise be unreachable. The device should be stable in construction and use to prevent accidental injuries and to ensure proper functioning of the nail gun.

SUMMARY OF THE INVENTION

The present invention meets the needs presented above by generally comprising an elongated pole that has a bottom end and a top end. A coupler is attached to the pole and is positioned adjacent to the top end. The coupler is configured to releasably secure a nail gun to the pole so that a nozzle of the nail gun is orientated generally perpendicular to a longitudinal axis of the pole and a trigger of the nail gun is adjacent to the top end. An actuating assembly is attached to the pole and is configured to selectively engage and actuate the trigger of the nail gun.

There has thus been outlined, rather broadly, the more important features of the invention in order that the detailed, description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the inventions are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
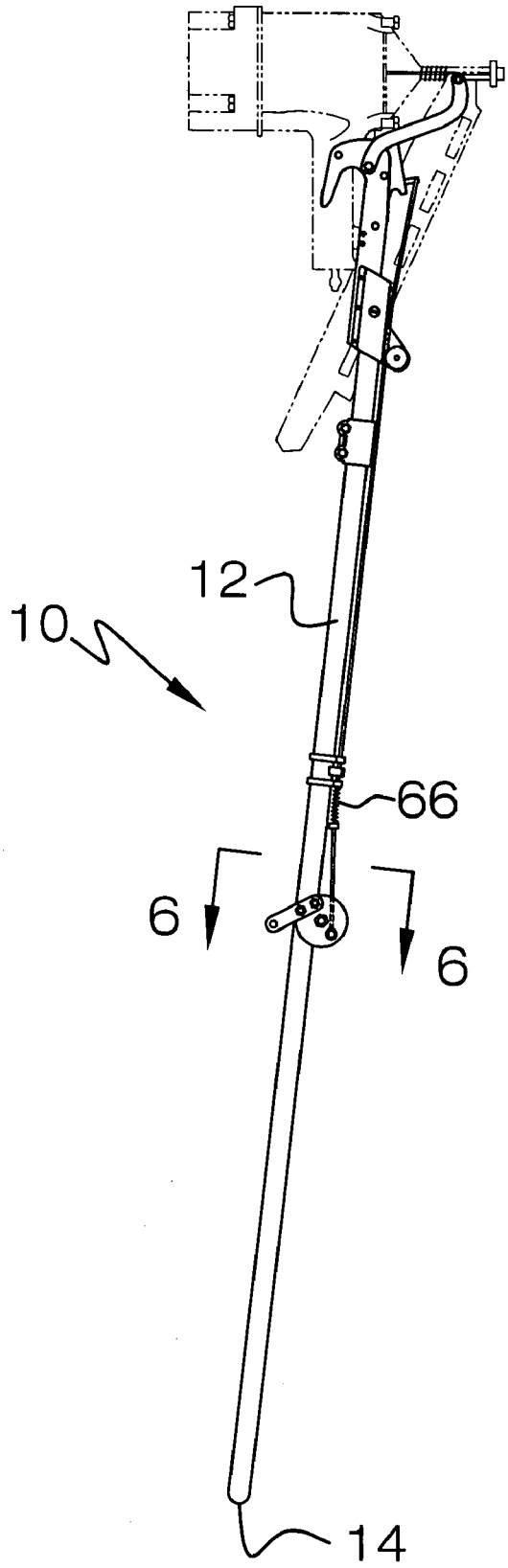
FIG. 1 is a side in-use view of a nail gun extension and actuating apparatus according to the present invention.
Figure 2:
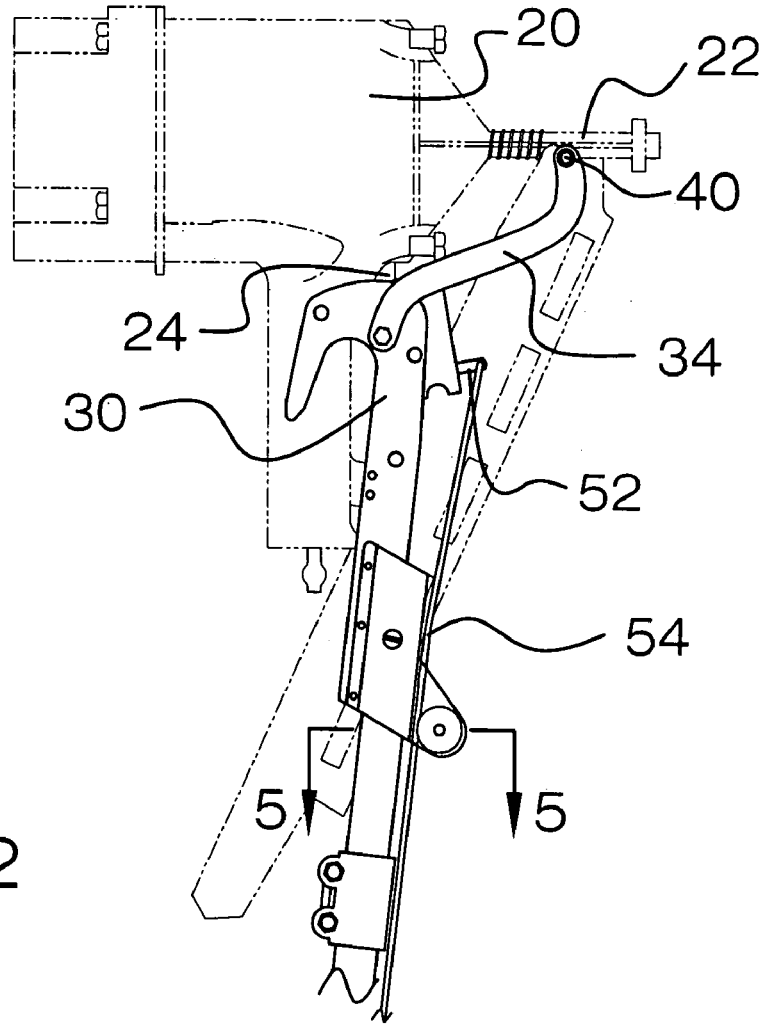
FIG. 2 is a first side view of the present invention.
Figure 3:
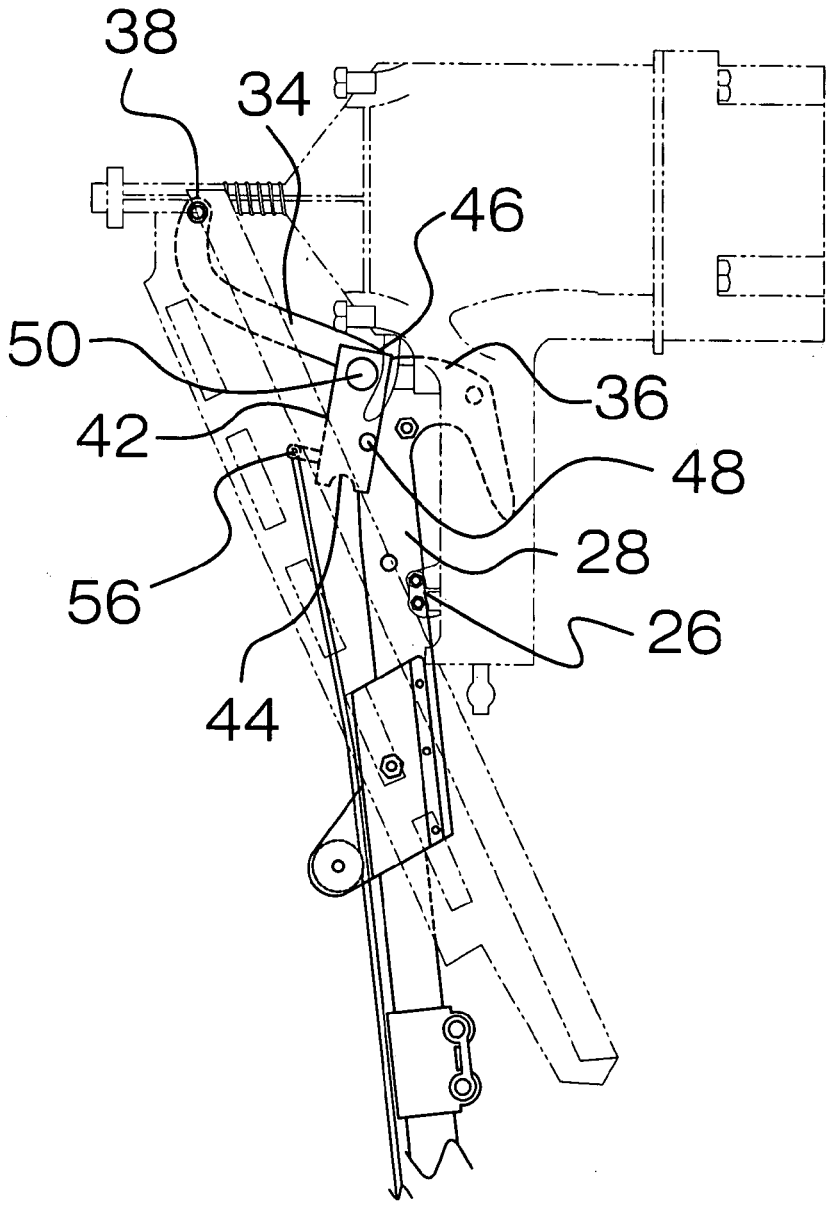
FIG. 3 is a second side view of the present invention.
Figure 4:
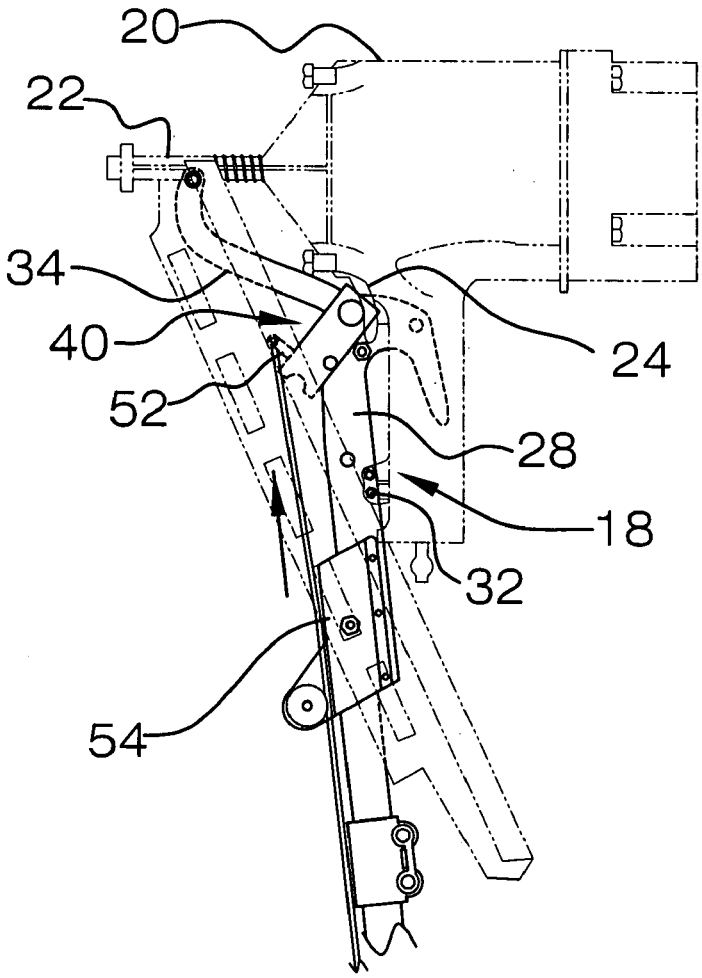
FIG. 4 is a front view of the present invention.
Figure 5:
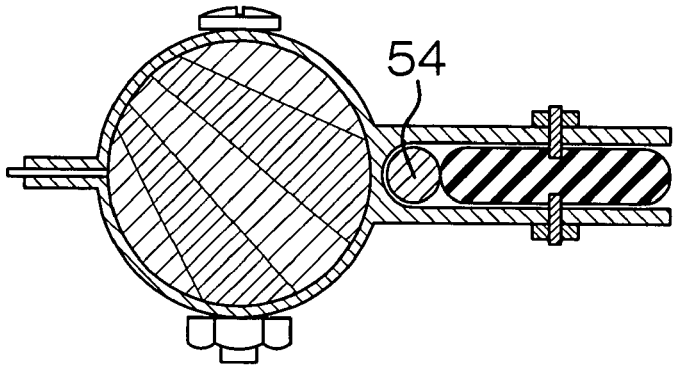
FIG. 5 is a cross-sectional view taken along line 5-5 of FIG. 3 of the present invention.
Figure 6:
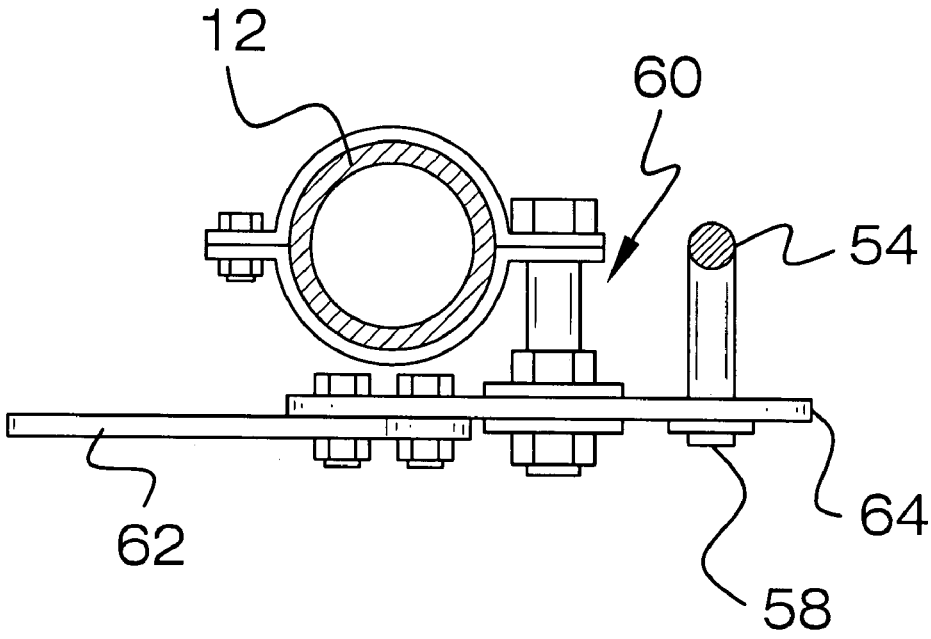
FIG. 6 is a cross-sectional view taken along line 6-6 of FIG. 3 of the present invention.

With reference now to the drawings, and in particular to FIGS. 1 through 6 thereof, a new tool extension device embodying the principles and concepts of the present invention and generally designated by the reference numeral 10 will be described.

As best illustrated in FIGS. 1 through 6, the nail gun extension and actuating apparatus 10 generally comprises an elongated pole 12 that has a bottom end 14 and a top end 16. The pole 12 is telescopic and has a selectable length generally between 6 feet and 14 feet.

A coupler 18 is attached to the pole 12 and is positioned adjacent to the top end 16. The coupler 18 is configured to releasably secure a nail gun 20 to the pole 12 so that a nozzle 22 of the nail gun 20 is orientated generally perpendicular to a longitudinal axis of the pole 12 and a trigger 24 of the nail gun 20 is adjacent to the top end 16. The coupler 18 includes a plate 26 that is attached to and extends upwardly from the pole 12. The plate 26 has a first side 28 and a second side 30. A plurality of fasteners 32 is removably extendable through the plate 26 and into the nail gun 20 adjacent to a handle of the nail gun 20. An arm 34 is attached to the plate 26 adjacent to an upper edge 36 of the plate 26. The arm 34 extends upwardly from the plate 26 and is angled with respect to a longitudinal axis of the pole 12. The arm 34 has a distal end 38 with respect to the plate 26. A fastener 40 extends through the arm 34 adjacent to the distal end 38 and into the nail gun 20 adjacent to the nozzle 22 so that the trigger 24 of the nail gun 20 is positioned between the distal end 38 and the plate 26.

An actuating assembly 40 is attached to the pole 12 and is configured to selectively engage and actuate the trigger 24 of the nail gun 20. The actuating assembly 40 includes a lever 42 having a lower end 44 and an upper end 46. A pivot rod 48 pivotally couples the lever 40 to the plate. The pivot rod 48 is positioned between the lower 44 and upper 46 ends and is orientated perpendicular to the longitudinal axis of the pole 12. A post 50 is attached to and extends outwardly from the lever 42. The post 50 is positioned adjacent to the upper end 46. The post 50 is orientated perpendicular to the longitudinal axis of the pole 12. The post 50 abuts the trigger 24 when the nail gun 20 is coupled to the pole 12. A leg 52 is attached to the lever 42 adjacent to the lower end 44 and is angled with respect to the lever 42. An elongated tether 54 has a first end 56 and a second end 58. The first end 56 is attached to the leg 52. The post 50 engages the trigger 24 when the first end 56 is pulled toward the bottom end 14 of the pole 12. An actuator 60 is attached to the pole 12 nearer to the bottom end 14 than the top end 16. The second end 58 of the tether 54 is attached to the actuator. The first end 56 is pulled toward the bottom end 16 of the pole 12 when the actuator 60 is actuated. The actuator 60 includes an elongated member 62 that is attached to a disc 64 that is rotatably coupled to the pole 12. The second end 58 is attached to disc 64 and may be pulled by rotation of the disc 64 with respect to the pole 12. A biasing member 66 is attached to tether 54 and biases the second end 58 toward the top end 16 of the pole 12.

In use, a nail gun 20 is attached to the apparatus 10 as described above. The pole 12 is extended to the height required and the nail gun 20 abutted against a surface into which a nail or staple is to be driven. The actuator 40 is then used to actuate the nail gun 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A nail gun extension and actuating assembly comprising:

an elongated pole having a bottom end and a top end;

a coupler being attached to said pole and being positioned adjacent to said top end, said coupler being configured to releasably secure a nail gun to said pole so that a nozzle of the nail gun is orientated generally perpendicular to a longitudinal axis of said pole and a trigger of the nail gun is adjacent to said top end, said coupler including:

a plate being attached to and extending upwardly from said pole, said plate having a first side and a second side, a plurality of fasteners being removably extendable through said plate and into the nail gun adjacent to a handle of the nail gun;

an arm being attached to said plate adjacent to an upper edge of said plate, said arm extending upwardly from said plate and being angled with respect to a longitudinal axis of said pole, said arm having a distal end with respect to said plate, a fastener extending through said arm adjacent to said distal end and into the nail gun adjacent to said nozzle such that the trigger of the nail gun is positioned between said distal end and said plate; and an actuating assembly being attached to said pole and being configured to selectively engage and actuate the trigger of the nail gun.

2. The assembly according to claim 1, wherein said pole is telescopic and having a selectable length generally between 6 feet and 14 feet.

3. The assembly according to claim 1, wherein said actuating assembly includes:

a lever having a lower end and an upper end, a pivot rod pivotally coupling said lever to said coupler, said pivot rod being positioned between said lower and upper ends, said pivot rod being orientated perpendicular to said longitudinal axis of said pole;

a post being attached to and extending outwardly from said lever, said post being positioned adjacent to said upper end, said post being orientated perpendicular to said longitudinal axis of said pole, said post abutting the trigger when the nail gun is coupled to said pole;

a leg being attached to said lever adjacent to said lower end and being angled with respect to said lever; and an elongated tether having a first end and a second end, said first end being attached to said leg, said post engaging the trigger when said first end is pulled toward said bottom end of said pole.

4. The assembly according to claim 3, further including an actuator being attached to said pole nearer to said bottom end than said top end, said second end of said tether being attached to said actuator, said first end being pulled toward said bottom end of said pole when said actuator is actuated.

5. The assembly according to claim 4, further including a biasing member being attached to tether and biasing said second end toward said top end of said pole.

6. The assembly according to claim 3, further including a biasing member being attached to tether and biasing said second end toward said top end of said pole.

7. A nail gun extension and actuating assembly comprising:

an elongated pole having a bottom end and a top end;

a coupler being attached to said pole and being positioned adjacent to said top end, said coupler being configured to releasably secure a nail gun to said pole so that a nozzle of the nail gun is orientated generally perpendicular to a longitudinal axis of said pole and a trigger of the nail gun is adjacent to said top end; and an actuating assembly being attached to said pole and being configured to selectively engage and actuate the trigger of the nail gun, said actuating assembly including:

a lever having a lower end and an upper end, a pivot rod pivotally coupling said lever to said coupler, said pivot rod being positioned between said lower and upper ends, said pivot rod being orientated perpendicular to said longitudinal axis of said pole;

a post being attached to and extending outwardly from said lever, said post being positioned adjacent to said upper end, said post being orientated perpendicular to said longitudinal axis of said pole, said post abutting the trigger when the nail gun is coupled to said pole;

a leg being attached to said lever adjacent to said lower end and being angled with respect to said lever; and an elongated tether having a first end and a second end, said first end being attached to said leg, said post engaging the trigger when said first end is pulled toward said bottom end of said pole.

8. The assembly according to claim 7, wherein said pole is telescopic and having a selectable length generally between 6 feet and 14 feet.

9. The assembly according to claim 7, wherein said coupler includes:

a plate being attached to and extending upwardly from said pole, said plate having a first side and a second side, a plurality of fasteners being removably extendable through said plate and into the nail gun adjacent to a handle of the nail gun;

an arm being attached to said plate adjacent to an upper edge of said plate, said arm extending upwardly from said plate and being angled with respect to a longitudinal axis of said pole, said arm having a distal end with respect to said plate, a fastener extending through said arm adjacent to said distal end and into the nail gun adjacent to said nozzle such that the trigger of the nail gun is positioned between said distal end and said plate.

10. The assembly according to claim 7, further including an actuator being attached to said pole nearer to said bottom end than said top end, said second end of said tether being attached to said actuator, said first end being pulled toward said bottom end of said pole when said actuator is actuated.

11. The assembly according to claim 10, further including a biasing member being attached to tether and biasing said second end toward said top end of said pole.

12. The assembly according to claim 7, further including a biasing member being attached to tether and biasing said second end toward said top end of said pole.

13. A nail gun extension and actuating assembly comprising:

an elongated pole having a bottom end and a top end, said pole being telescopic and having a selectable length generally between 6 feet and 14 feet;

a coupler being attached to said pole and being positioned adjacent to said top end, said coupler being configured to releasably secure a nail gun to said pole so that a nozzle of the nail gun is orientated generally perpendicular to a longitudinal axis of said pole and a trigger of the nail gun is adjacent to said top end, said coupler including;

a plate being attached to and extending upwardly from said pole, said plate having a first side and a second side, a plurality of fasteners being removably extendable through said plate and into the nail gun adjacent to a handle of the nail gun;

an arm being attached to said plate adjacent to an upper edge of said plate, said arm extending upwardly from said plate and being angled with respect to a longitudinal axis of said pole, said arm having a distal end with respect to said plate, a fastener extending through said arm adjacent to said distal end and into the nail gun adjacent to said nozzle such that the trigger of the nail gun is positioned between said distal end and said plate;

an actuating assembly being attached to said pole and being configured to selectively engage and actuate the trigger of the nail gun, said actuating assembly including;

a lever having a lower end and an upper end, a pivot rod pivotally coupling said lever to said plate, said pivot rod being positioned between said lower and upper ends, said pivot rod being orientated perpendicular to said longitudinal axis of said pole;

a post being attached to and extending outwardly from said lever, said post being positioned adjacent to said upper end, said post being orientated perpendicular to said longitudinal axis of said pole, said post abutting the trigger when the nail gun is coupled to said pole;

a leg being attached to said lever adjacent to said lower end and being angled with respect to said lever;

an elongated tether having a first end and a second end, said first end being attached to said leg, said post engaging the trigger when said first end is pulled toward said bottom end of said pole;

an actuator being attached to said pole nearer to said bottom end than said top end, said second end of said tether being attached to said actuator, said first end being pulled toward said bottom end of said pole when said actuator is actuated; and a biasing member being attached to tether and biasing said second end toward said top end of said pole.

* * * * *